US006710101B2

(12) United States Patent
Chen

(10) Patent No.: US 6,710,101 B2
(45) Date of Patent: Mar. 23, 2004

(54) HIGH SURFACE AREA MAGNESIA CURING AGENT

(75) Inventor: Jimmy Pingao Chen, Prospect, KY (US)

(73) Assignee: Borden Chemical Inc., Columbus, OH (US)

( * ) Notice: Subject to any disclaimer, the term of this patent is extended or adjusted under 35 U.S.C. 154(b) by 0 days.

(21) Appl. No.: 10/342,799

(22) Filed: Jan. 15, 2003

(65) Prior Publication Data

US 2003/0153648 A1 Aug. 14, 2003

Related U.S. Application Data

(60) Provisional application No. 60/349,683, filed on Jan. 17, 2002.

(51) Int. Cl.[7] ..... B22C 1/22
(52) U.S. Cl. ..... 523/145

(56) References Cited

U.S. PATENT DOCUMENTS

| | | | | |
|---|---|---|---|---|
| 2,623,865 | A | | 12/1952 | Dietz |
| 2,869,194 | A | | 1/1959 | Cooper |
| 3,409,579 | A | | 11/1968 | Robins |
| 3,676,392 | A | | 7/1972 | Robins |
| 4,540,724 | A | | 9/1985 | Dunnavant et al. |
| 4,848,443 | A | * | 7/1989 | Westwood et al. ..... 164/527 |
| 4,994,505 | A | | 2/1991 | Gerber |
| 5,248,707 | A | | 9/1993 | Gerber |
| 5,281,644 | A | | 1/1994 | Iyer et al. |
| 5,284,808 | A | | 2/1994 | Damiano et al. |
| 5,294,649 | A | | 3/1994 | Gerber |
| 5,334,675 | A | | 8/1994 | Gerber |
| 6,232,368 | B1 | | 5/2001 | White |

OTHER PUBLICATIONS

Martin Marietta Magnesia Specialties, Technical Bulletin for "Magchem® Light Burned Technical Grade Magnesium Oxide in Neoprene® W," 3 pages, Baltimore, MD, USA, http://www.magspecialties.com/mc50–neoprene–w.htm, ©2001.

* cited by examiner

*Primary Examiner*—Matthew A. Thexton
(74) *Attorney, Agent, or Firm*—Gardner Carton & Douglas LLP

(57) ABSTRACT

Binder compositions of the present invention are useful in refractory and foundry applications. The compositions include an aggregate, a liquid resole resin, and a magnesium hardening agent. The compositions are workable and exhibit high compressive strengths in a short period of time. Additionally, the compositions have a low free phenol content and require a reduced resin content as compared to currently known compositions. The compositions reduce the cost to produce useful binders by eliminating the requirement for ester curing in addition to requiring reduced amounts of resin to obtain adequate compressive strength.

22 Claims, No Drawings

HIGH SURFACE AREA MAGNESIA CURING AGENT

This application claims the benefit of U.S. Provisional Application No. 60/349,683, filed Jan. 17, 2002.

FIELD OF THE INVENTION

The invention relates to a room temperature curing binder for refractory or foundry applications. The binder incorporates lightburned magnesium oxide particles.

BACKGROUND OF THE INVENTION

The control of the ambient temperature curing of binder compositions is useful in the foundry and refractory arts. In foundry and refractory applications, the binder is mixed with sand or other refractory material and various shapes are formed with the help of pattern equipment. Room temperature or ambient temperature hardening systems, used in foundry and refractory applications depend on their ability to uniformly coat sand or other refractory grains which then cure into strong, rigid shapes at ambient conditions.

One room temperature cure process, known as ester cure, uses a highly alkaline phenolic resole resin with a pH greater than 11 and an alkali to phenol molar ratio of 0.2/1 to 1.2/1. Generally, the binder components are mixed into sand in either a batch or a continuous process and the mixed sand is discharged into a pattern. The sand begins to cure or harden immediately and it is essential to sufficiently pack the sand to achieve optimum bonding strength. If the sand cannot be sufficiently packed prior to curing there is a diminished bonding strength. The usefulness of a binder is related to the amount of time available to sufficiently work the binder into a pattern prior to curing of the binder.

Compositions for retarding the ambient temperature hardening of a phenolic resole resin alone or with an aggregate when such resin is contacted with a nitroalkane and a hardening agent such as lightburned magnesium oxide have been used. The pH of the phenolic resole resin used in that application varied over a broad range from about 4.5 to 13. However, hardening takes place at a pH above 7, i.e., in the alkaline range such as that above 7.5. When the hardener is lightburned magnesium oxide alone or together with an ester functional hardening agent, the pH of the resin can be below 7 such as between a pH of 4.5 and 7, but a sufficient amount of the lightburned magnesium oxide needs to be present to both neutralize the acidity and to provide sufficient magnesium oxide for the crosslinking and hardening of the resin.

Ambient temperature hardening of compositions containing magnesia aggregate and a curable, liquid phenolic resin, either alone or together with an ester function hardening agent, has been accelerated by the use of additives such as those which supply: acetate; adipate; 1,2,4-benzenetricarboxylate (trimellitate); formate; glycolate; lactate; nitrate; succinate; sulfamate; phenolsulfonate; or toluenesulfonate anions to the composition or compounds which supply acetylacetone (2,4-pentanedione); 2-nitrophenol; 4-nitrophenol; or salicylaldehyde to the composition. This curing method has been used with resole resins having a molar ratio of phenol-to-formaldehyde of between about 1:0.9 and 1:3. However, the phenol-to-formaldehyde ratios on the lower end of this range do not produce high strength binders in a short period of time. A novolac resin could also be used as a liquid solution if used alone as the phenolic resin or as a liquid or solid when used together with a resole solution.

Lightburned magnesium oxide products having different surface areas can be obtained from various sources such as the Martin Marietta Magnesia Specialties Company, Baltimore, Md., under the designator of MAGCHEM Magnesium Oxide Products. Lightburned magnesium oxides with the higher surface areas are more active and provide shorter times for gelation and hardening. Reactivity and surface area of magnesium oxide (magnesia) differ greatly depending on the procedure used for manufacture of the magnesia. Thus, lightburned magnesia has a surface area of about 10 to 200 or more square meters per gram. Hardburned magnesia and deadburned magnesia have a surface area of about one or less than one square meter per gram.

For use in refractory compositions, the magnesia grain has been crushed and sized in various fractions. Commonly used grain sizes of deadburned or hardburned grades of magnesia have been used for room temperature hardening, meaning the hardening of binder-aggregate compositions took place at temperatures of about 60° F. to 90° F.

Known binder-aggregate compositions produced by combining a curable resin binder, magnesia aggregate, and accelerator have additionally comprised a number of optional modifiers or additives including: non-reactive solvents; silanes; hexamethylenetetraamine; clays; graphite; iron oxide; carbon pitch; silicon dioxide; metal powders such as aluminum, magnesium, and silicon; surfactants; dispersants; air detraining agents; and mixtures thereof.

There is a need for a refractory mixture that cures at room temperature that provides adequate work time and then cures quickly and has sufficient compressive strength. There is further a need for such a refractory composition that provides a lower free phenol content and can be produced at a lower cost due to a decrease in the required resin concentration.

SUMMARY OF THE INVENTION

The present invention provides refractory compositions that minimize resin content. The advantages related to decreased resin concentration in the refractory mixtures are two-fold. First, the product cost is reduced, and secondly, there is a reduction in emissions associated with the resin. The compositions are workable and exhibit high compressive strengths in a short period of time. Additionally, the refractory mixtures of the present invention have a low free phenol content and require a reduced resin content as compared to compositions of the prior art. The refractory mixtures provided in the invention further reduce the cost to produce useful articles by eliminating the requirement for ester curing in addition to requiring reduced amounts of resin to obtain adequate compressive strength.

The present invention is directed to a composition including a liquid resole having a mole ratio of phenol to formaldehyde ranging from about 1:2.0 to about 1:2.4; an aggregate; and a magnesium hardening agent.

DETAILED DESCRIPTION OF THE INVENTION

According, to one embodiment of the present invention there is provided a room temperature curing composition using varying concentrations of lightburned magnesium oxide. The compositions of the present invention use a liquid resole having a specified mole ratio of phenol-to-formaldehyde. It has been discovered that the use of the liquid resole of the present invention in combination with the lightburned magnesium oxide described herein provides surprising and unexpected rates of hardening and compressive strength development as compared to prior art compositions using ester, phenolic resole and lightburned magnesium oxide.

In another embodiment of the present invention there is provided a binder composition, including:

an aggregate;

a liquid resole having a mole ratio of phenol to formaldehyde ranging from about 1:2.0 to about 1:2.4, in an amount ranging from about 1% to about 20% by weight, based on the total weight of the aggregate;

lightburned magnesium oxide in an amount ranging from about 0.5% to about 50% by weight, based on the total weight of the liquid resole.; and a solvent in an amount ranging from 0% to about 25% by weight, based on the total weight of the aggregate.

The term "hardening agent" is used herein to denote a material which increases the rate of hardening of a phenolic resole resin, e.g., at room or ambient temperature (R.T.). Hardening is attained with increases in viscosity and gelation to form a solid that is firm to the touch and generally inflexible. An example of a lightburned magnesium hardening agent is lightburned magnesium oxide.

By the term "room temperature hardening" we mean the hardening of compositions of this invention at temperature of about 60° F. to 90° F., particularly about 65° F. to 80° F.

The magnesium hardening agents are magnesium hydroxide, lightburned magnesium oxide, or other magnesium oxide which has the hardening activity for phenolic resole resins of lightburned magnesium oxide such as that having a surface area of at least 10 square meters per gram (10 $m^2/g$).

Reactivity and surface area of magnesium oxide ("magnesia") differ greatly depending on the procedure used for manufacture of the magnesia. Lightburned grades or magnesium oxide are calcined at temperatures ranging from about 1600° to 1800° F. Hardburned grades are calcined at temperatures ranging from about 2800° to 3000° F. Deadburned or periclase grade of magnesium oxide is calcined at temperatures of over 4000° F. The lightburned grades are generally available in powder or granulated form while hardburned grades are available in kiln run, milled, or screened sizes. Periclase is generally available as briquettes and as screened or milled fractions. There are large differences in surface areas for the various magnesias. Thus, lightburned magnesia has a surface area of about 10 to 200 or more, square meters per gram ($m^2/g$). Hardburned magnesia has a surface area of about one square meter per gram, whereas deadburned magnesia has a surface area of less than one square meter per gram. Magnesia which is conventionally used as a refractory aggregate is the deadburned or periclase magnesia. Neither hardburned nor deadburned magnesia are effective hardening agents. It is the lightburned magnesia which is an effective hardening agent. Lightburned magnesia products having different surface areas can be obtained from the Martin Marietta Magnesia Specialties Company, Baltimore, Md., under the designator of MAGCHEM Magnesium Oxide Products. Illustratively, MAGCHEM 30 has a surface area of about 25 square meters per gram. MAGCHEM 50 has a surface area of about 65 square meters per gram whereas MAGCHEM 200D has a surface area of about 170 square meters per gram. In the present invention, the amount of lightburned magnesia to be used is dependent on the surface area of lightburned magnesia employed. For example, comparatively less MAGCHEM 200D would be used than MAGCHEM 50, and less MAGCHEM 50 would be used than MAGCHEM 30.

One of the variables influencing viscosity increase, formation of gel and subsequent hardening of a phenolic resole resin is the surface area of the lightburned magnesium oxide. Magnesium oxides having higher surface areas are more active and provide shorter times for gelation and hardening. Thus, lightburned magnesium oxide, having a surface area of less than about 25 square meters per gram, is slow acting and generally will not be used when it is desired to have the binder composition cure in a relatively short period of time at temperatures below about 120° F. On the other hand, magnesia having a higher surface area, such as about 65 square meters per gram ($m^2/g$) and above, will harden the same binder composition in a shorter period of time. For many applications, using magnesia having a surface area of about 25 to 65 square meters per gram is suitable. Hardburned magnesia reacts too slowly as a hardener to be of practical value, and deadburned magnesia is sufficiently inert so that it is used conventionally as a refractory with phenolic resin binders with little or no effect on room temperature hardening rates.

The quantity of lightburned magnesium oxide or magnesium hydroxide which is used in this invention as a hardener is an amount sufficient to increase the rate of gelation or hardening of the phenolic resole resin.

Preferred phenolic resole resins used in this invention have less than about 2% by weight of water soluble sodium or potassium. A preferred molar ratio for use in this invention ranges from about 1 mole of the phenol for each 2.0 moles of the aldehyde to about 1 mole of phenol for each 2.4 moles of the aldehyde and particularly a range of phenol to aldehyde of about 1:2.1 to about 1:2.3. The phenolic resole resin will usually be used in solution.

The pH of the phenolic resole resin used in this invention will generally range from about 8 to about 9, a preferred range being firm about 8.5 to about 9.

The liquid portion of the resin is water or water together with a non-reactive solvent. The resin can include a number of optional modifiers or additives such as silanes, hexamethylenetetramine, or urea. Solvents useful for the present invention in addition to water can be selected from alcohols of one or five carbon atoms, diacetone, alcohol, glycols of 2 to 6 carbon atoms, mono- and dimethyl or butyl ethers of glycols, low molecular weight (200–600) polyethylene glycols and methyl ethers thereof, phenolics of 6 to 15 carbons, phenoxyethaniol, lactones such as γ-butyrolactone, γ-valerolactone, and δ-valerolactone, aprotic solvents such as N,N-dimethylformamide, N,N-dimethylacetamide, 2-pyrrolidinone, N-methyl-2-pyrrolidinone, dimethyl sulfoxide, tetramethylene sulfone, hexamethylphosphoramide, tetramethyl urea, methyl ethyl ketone, methyl isobutyl ketone, cyclic ethers such as tetrahydrofuran and m-dioxolane, and the like, and mixtures thereof. Under certain conditions of elevated alkalinity, esters and lactones such as γ-butyrolactone may be reactive with the resole.

Preferred water contents for the resins used in this invention will vary from about 18% to about 24% by weight of the resin and can thus be referred to as aqueous solutions.

Organofunctional silane adhesion promoters are recommended for use when compositions of this invention include siliceous aggregates, such as silica sands, crushed rock and silicates, and alumina based aggregates.

The organofunctional silanes are used in a quantity sufficient to improve adhesion between the resin and aggregate. Typical usage levels of these silanes are 0.1 to 1.5% based on resin weight. Illustrative of silanes that are useful are those represented by the generic Formula (I).

$$(RO)_3\text{—Si—OR} \qquad (1)$$

The compositions of this invention can include fillers, modifiers, and aggregates which are conventionally used with phenolic resole resins. The aggregate material may be a particulate material such as that in granular, powder, or flake form. Suitable aggregate materials include but are not limited to: magnesia, magnesite, alumina, zirconia, silica, zircon sand, olivine sand, silicon carbide, silicon nitride, boron nitride, bauxite, quartz, chromite, and corundum. For certain applications, low density aggregate materials such as vermiculite, perlite, and pumice are preferred. For other applications, preferable high density aggregates include: limestone, quartz, sand, gravel, crushed rock, broken brick, and air cooled blast furnace slag. Sand, gravel, and crushed rock are preferred aggregates in polymeric concrete. Fillers such as calcium carbonate, kaolin, mica, wollastonite, and barites can be used in quantities of up to about 50% by weight of the formulated resin product. The quantity of such fillers can equal the quantity of the resin. Hollow microspheres of glass, phenolic resin, or ceramic can also be used in quantities of up to about 20% of the formulated resin product. Other optional modifiers, particularly in polymer concrete, include fibers such as steel, alkali resistant glass, polyester, carbon, silicon carbide, asbestos, wollastonite fibers, and aromatic polyimides such as KEVLAR® aramid fiber which is sold by Dupont Advanced Fiber Systems, Richmond, Va., and polypropylene. The quantity of such fibers can vary over a wide range sufficient to improve the strength of the composition, e.g., from about 2% to 5% by weight of aggregate when aggregate is used in the composition.

The raw batch compositions produced by combining the hardenable resin binder, aggregate and hardening agent may additionally comprise any of a number of optional modifiers or additives including non-reactive solvents, silanes, hexamethylenetetraamine, clays, graphite, iron oxide, carbon pitch, silicon dioxide, metal powders such as aluminum, magnesium, silicon, surfactants, dispersants, air detraining agents, and mixtures thereof. Air detraining agents such as antifoamers, e.g., dimethylpolysiloxane and the like, can be employed in an amount sufficient to increase the strength of the composition. Such quantities can vary over a broad range such as from about 0.005% to 0.1% based on the weight of resin and preferably from about 0.01% to 0.05% based on the weight of resin. Illustrative of additional air detaining agents there can be mentioned: various acetylenic derivatives such as the SURFYNOLS of Air Products and Chemicals, Inc., Allentown, Pa., such as SURFYNOL DF-110L, SURFYNOL 104, and SURFYNOL GA; and various siloxanes such as dimethylpolysiloxane and dimethylsiloxane-alkylene oxide block Copolymer Such as PS073 which is supplied by United Chemical Technologies, Inc., Bristol, Pa.

In foundry applications and sand-binder overlays, or where silica sand is used as the aggregate, a preferred additive is a silane adhesion promoter, such as 3-aminopropyltriethoxysilane. In refractory applications, clays, metal powders (e.g., aluminum, magnesium, or silicon), and graphite are preferred additives. When graphite or metal powders of aluminum, magnesium, or silicon or mixtures thereof are used as additives, the amount of aggregate, such as alumina or magnesia, can be reduced to as low as about 70% by weight of the composition.

Phenolic Resole

Resole resins are thermosetting, i.e., they form an infusible three-dimensional polymer upon application of heat and are produced by the reaction of a phenol and a molar excess of a phenol-reactive aldehyde typically in the presence of an alkali, alkaline earth, or other metal compound as a condensing catalyst.

The phenolic resole which may be used with the embodiments of the present invention may be obtained by the reaction of a phenol, such as phenol itself, cresol, resoicinol, 3,5-xylenol, bisphenol-A, other substituted phenols, and mixtures of any of these compounds, with an aldehyde such as, for example, formaldehyde, paraformaldehyde, acetaldehyde, furfuraldelhyde, and mixtures of any of these aldehydes.

A broad range of phenolic resoles in fact may be used with the various embodiments of this invention. These can be phenol-formaldehyde resoles or those where phenol is partially or completely substituted by one or more reactive phenolic compounds and the aldehyde portion can be partially or wholly replaced by other aldehyde compounds. The preferred phenolic resole resin is the condensation product of phenol and formaldehyde.

A molar excess of aldehyde per mole of phenol is used to make the resole resins used in the present inventions. The preferred molar ratio of phenol to aldehyde is in the range of from about 1:2.0 to about 1:2.4. A convenient way to carry out the reaction is by heating the mixture under reflux at atmospheric or reduced pressure conditions. Reflux, however, is not required.

The reaction mixture, is typically heated until from about 80 percent to about 98 percent of the aldehyde has reacted. Although the reaction call be carried out under reflux until about 98 percent of the aldehyde has reacted, prolonged heating is required and it is preferred to continue the heating only until about 80 percent to 90 percent of the aldehyde has reacted. At this point, the reaction mixture is heated under vacuum at a pressure of about 50 mm of Hg until the free formaldehyde in the mixture is less than about 1 percent to about 2 percent. Preferably, the reaction is carried out at 95° C. until the free formaldehyde is less than about 0.1 percent by weight of the mixture. The catalyst may be precipitated from the reaction mixture before the vacuum heating step if desired.

Levels of free phenol and free formaldehyde are measured by methods well known in the art.

Preparation

The preferred phenolic resole used here is a liquid resole having the phenol and formaldehyde ratio of about 1:2.2. The resole is further mixed with silica sand, a magnesium oxide curing component and water. Lightburned magnesium oxide particles are preferred at a concentration of between about 0.5% and 50%, and more preferably between about 12% and 18%. The binders were prepared as described below and tested for compressive strength at room temperature after 3 to 4 hours and then again at 24 hours post preparation. Compressive strength was also tested after the binder samples were heated to 110° C. or 125° C. in an oven for about 1 hour.

Two standard resole resins were used in the examples that follow. The standard resole resins were Resin 1 having a phenol-to-formaldehyde ratio of 1:2.2, and Resin 2 having a phenol-to-formaldehyde ratio of about 1:0.9. Both resins are conventional liquid resoles. Refractory Mixtures A–D were prepared employing either Resin 1 or Resin 2. The silica sand used in Refractory Mixtures A–K was 60 mesh; however, silica sand of varying grain size may be used. The units for the components of Refractory Mixtures A–D were based on the silica sand content being set to 200 parts and all other components were then set to parts per two hundred of silica sand. After preparation the damp binders were hand-pressed into 20-gram nuggets of about 1 and ⅝-inch in diameter and about ⅜-inch thickness. The compressive strengths of the nuggets made from Refractory Mixtures A–D are summarized in Table 1.

| Refractory Mixture A | |
|---|---|
| Silica sand | 200 |
| MAGCHEM 50 | 1.8 |
| Resin 1 | 12 |
| Water | 4 |

The silica sand and MAGCHEM 50 were mixed together and then the resin and water were added and mixed and mixed thoroughly for 5 minutes. MAGCHEM 50 is a lightburned magnesium oxide available from Martin Marietta Magnesia Specialties Company, Baltimore, Md. The temperature of the refractory mixture increased from 24° C. to 26° C. The material was vibratable in damp form.

| Refractory Mixture B | |
|---|---|
| Silica sand | 200 |
| MAGCHEM 50 | 2.4 |
| Resin 1 | 12 |
| Water | 4 |

The silica sand and MAGCHEM 50 were mixed then the resin and water were added and mixed thoroughly. The temperature of the refractory mixture increased from 24° C. to 26° C. The material was not vibratable in damp form.

| Refractory Mixture C | |
|---|---|
| Silica Sand | 200 |
| MAGCHEM 50 | 1.5 |
| Resin 1 | 10 |
| Water | 4 |

The silica sand and MAGCHEM 50 were mixed thoroughly for about 5 minutes. The resin and water were added and mixed thoroughly for 5 minutes. The temperature of the refractory mixture increased from 24° C. to 26° C. The material was vibratable in damp form.

| Refractory Mixture D | |
|---|---|
| Silica sand | 200 |
| MAGCHEM 50 | 1.2 |
| Resin 1 | 8 |
| Water | 4 |

The silica sand and MAGCHEM 50 were mixed together and the resin and water added and mixed thoroughly for 5 minutes. The temperature of the refractory mixture increased from 23° C. to 24° C. The material was damp, but did not vibrate well.

Compressive Strength Analysis

The Locap Testing Machine manufactured by Tinius Olsen, Willow Grove, Pa., was used for the compression strength analysis. The test measures the compression strength parallel to the surface of a specimen ("nugget") by the following steps: (1) the surface of a cylindrical test specimen is carefully ground for smoothness and to provide right angles at the cylindrical edges; (2) the specimen is placed on the machine surface; (3) a vertical load is applied to the flat surface of the specimen at a rate of about 0.1 inch per minute; (4) a digital display indicates the load at increasing intervals of 5 pounds until the specimen fails; and (5) the final load is divided by the surface area of the specimen to arrive at a compressive strength in units of pounds per square inch ("psi").

TABLE 1

Compressive Strength of Refractory Mixtures A–C after 3–4, and 24 hours at room temperature and after 1 hour at 110° C.

| Refactory Mixture/Time/Temperature | Sample | Compressive Strength, psi |
|---|---|---|
| A/4 hours/room temperature | 1 | 347 |
| | 2 | 311 |
| | 3 | 145 |
| A/24 hour/room temperature | 1 | 540 |
| | 2 | 441 |
| | 3 | 299 |
| A/1 hour/110° C. | 1 | 1088 |
| | 2 | 1080 |
| | 3 | 895 |
| B/3.5 hours/room temperature | 1 | 1254 |
| | 2 | 427 |
| | 3 | 169 |
| B/24 hours/room temperature | 1 | 825 |
| | 2 | 832 |
| | 3 | 702 |
| B/1 hour/110° C. after 1 hour at room temperature | 1 | 1114 |
| | 2 | 1317 |
| | 3 | 2018 |
| C/3 hours/room temperature | 1 | 936 |
| | 2 | 579 |
| | 3 | 692 |
| C/24 hours/room temperature | 1 | 921 |
| | 2 | 1160 |
| | 3 | 1064 |
| | 4 | 603 |
| C/1 hour/110°C. after 1 hour at room temperature | 1 | 1527 |
| | 2 | 1508 |
| | 3 | 1797 |
| D/3.5 hours/room temperature | 1 | 217 |
| | 2 | 355 |
| | 3 | 280 |
| | 4 | 596 |
| D/24 hours/room temperature | 1 | 504 |
| | 2 | 649 |
| | 3 | 866 |
| D/1 hour/110° C. after 1 hour room temperature | 1 | 877 |
| | 2 | 810 |
| | 3 | 926 |

To test the limitations of the effectiveness of the magnesium oxide curing agent in the phenol-to-formaldehyde ratio range of about 1:0.9 to about 1:2.2, the following refractory mixtures. Refractory Mixtures E–I were prepared. In addition to magnesium oxide, a solvent was used. Similar to the preparation of Refractory Mixtures A–D, the units lot the components of refractory Mixtures E–G were based on the silica sand content being set to 100 parts and all other components were than set to parts per 100 of silica sand.

The preparation of Refractory Mixtures E–G was as follows: The silica sand and MAGCHEM 50 were mixed together, then the resin and γ-butyrolactone were added and mixed for 2 minutes. The refractory mixtures were hand-pressed into 2 pills or nuggets of 1-inch diameter and ⅜-inch thickness.

| Refractory Mixture E | |
|---|---|
| Silica sand | 100 |
| Resin 2 | 12 |
| γ-butyrolactone | 3.21 |
| MAGCHEM 50 | 1.5 |
| **Refractory Mixture F** | |
| Silica sand | 100 |
| MAGCHEM 50 | 1.5 |
| Resin 1 | 12 |
| γ-butyrolactone | 3.22 |
| **Refractory Mixture G** | |
| Silica sand | 100 |
| MAGCHEM 50 | 1.5 |
| 50:50 Resin 1:Resin 2 | 12 |
| γ-butyrolactone | 3.24 |
| **Refractory Mixture H** | |
| Silica sand | 200 |
| MAGCHEM 50 | 1.5 |
| Resin 2 | 10 |
| Water | 4 |

The units for the components of Refractory Mixture H were based oil the silica sand content being set to 200 parts and all of the components were then set to parts per two hundred of silica sand. Refractory mixture H was prepared by mixing the silica sand and MAGCHEM 50 thoroughly for 1 minute and then adding the resin and water and mixing thoroughly for 5 minutes. No temperature change occurred. The damp material was vibratable. The mixture was left to stand for 30 minutes prior to being hand pressed into 20-gram nuggets of 1 and ⅝-inch diameter and ⅜-inch thickness.

Qualitative results of strength of Refractory Mixtures E–H are summarized in Table 2.

TABLE 2

Strength Results and Qualitative Observation of Refractory Mixtures E–H

| Refractory Mixture | Phenol-to-formaldehyde ratio of the resole | Strength Results and Qualitative Observations (at room temperature) |
|---|---|---|
| E | 1:0.9 | After 5 hours the mixture was soft and could be broken with fingertips. After 22 hours, the mixture was firmer, but easily broken. |
| F | 1:2.2 | After 3 hours the mixture had hardened. Compression strength after 3 hours was 242 psi; after 22 hours, 363 psi. |
| G | 1:1.5 | After 3 hours the mixture had hardened. Compression strength after 3 hours was 6.37 psi; after 22 hours, 114 psi. |
| H | 1:0.9 | After 3 hours the mixture was soft. After 7 hours the mixture had hardened slightly, but could be broken with fingertips. After 24 hours the mixture deformed and no compression strength could be measured. |

The differences in compressive strength varied surprisingly and unexpectedly with the phenol-to-formaldehyde ("P/F") ratio in the range of resins tested. The teachings of the prior art suggested that similar refractory mixture strength should be observed with the use of resole resins in the P/F ratio of between about 1:1 and about 1:3. However, the strengths of the refractories produced in these examples are not unrelated to the phenol-to-formaldehyde ratio in the studied range. In fact, the compression strength of refractories in the, range of P/F ratios of about 1:1 to about 1:1.5 are surprisingly lower than the compression strengths of refractories containing resins that have a P/F ratio of between about 1:2.0 and about 1:2.4.

The units of the components of Refractory Mixtures I, J and K were based on the silica sand content being set to 200 parts and all other components are then set to parts per two hundred of silica sand.

| Refractory Mixture I | |
|---|---|
| Silica sand | 200 |
| MAGCHEM 50 | 2 |
| Resin 1 | 16 |
| Water | 2 |
| γ-butyrolactone | 4.29 |

The silica sand and MAGCHEM 50 were mixed together, then the resin, water and γ-butyrolactone were added and mixed. The mixture was hand-pressed into 20-gram nuggets each of 1 and ⅝-inch diameter with a thickness of ⅜-inch. The material was vibratable and the binder temperature increased from 24° C. to 29° C. The results of the compressive strength analysis of the binder are summarized in Table 3.

| Refractory Mixture J | |
|---|---|
| Silica sand | 200 |
| MAGCHEM 50 | 1.5 |
| Resin 1 | 12 |
| Water | 3 |
| γ-butyrolactone | 3.22 |

The silica sand and MAGCHEM 50 were mixed together, then the resin, water and γ-butyrolactone were added and mixed. The mixture was hand-pressed into 20-gram nuggets each of 1 and ⅝-inch diameter with a ⅜-inch thickness. The material was vibratable. The temperature of the binder increased from 24° C. to 29° C. The results of the compressive strength of the binders are summarized in Table 3.

| Refractory Mixture K | |
|---|---|
| Silica sand | 200 |
| MAGCHEM 50 | 1 |
| Resin 1 | 8 |
| Water | 4 |
| γ-butyrolactone | 2.15 |

The silica sand and MAGCHEM 50 were mixed thoroughly and then the resin, water and γ-butyrolactone were added and mixed thoroughly for 5 minutes. The temperature of the mixture increased from 24° C. to 26° C. The material was vibratable. The mixture was hand-pressed into 20-gram nuggets each of 1 and ⅝-inch diameter with a thickness of ⅜-inch. The results of the compressive strength of the binders are summarized in Table 3.

TABLE 3

Compressive Strength Results for Refractory Mixtures I–K.

| Refractory Mixture/Time/ Temperature | Sample | Compressive Strength, psi |
|---|---|---|
| I/3 hours/room temperature | 1 | 193 |
| | 2 | 212 |
| | 3 | 374 |
| I/24 hours/room temperature | 1 | 396 |
| | 2 | 403 |
| | 3 | 646 |
| | 4 | 552 |
| I/1 hour, 45 minutes at room temperature then 1 hour, 15 minutes at 125° C. | 1 | 3877 |
| | 2 | 1181 |
| | 3 | 4060 |
| J/3 hours/room temperature | 1 | 263 |
| | 2 | 239 |
| | 3 | 236 |
| J/72 hours/room temperature | 1 | 323 |
| | 2 | 250 |
| | 3 | 632 |
| J/1 hour, 45 minutes at room temperature then 1 hour, 15 minutes at 125° C. | 1 | 3136 |
| | 2 | 1809 |
| | 3 | 2424 |
| | 4 | 2171 |
| K/2 hours/room temperature | 1 | 150 |
| K/3 hours/room temperature | 1 | 157 |
| | 2 | 75 |
| | 3 | 80 |
| K/48 hours/room temperature | 1 | 270 |
| K/1 hour, 45 minutes/125° C. | 1 | 1257 |
| | 2 | 521 |
| K/1 hour, 15 minutes/125° C. | 1 | 1428 |
| | 2 | 1035 |

Examples of further embodiments of the present invention are Refractory Mixtures L–Q. Magnesium oxide aggregate was used in Refractory Mixtures L–Q. Magnesium oxide aggregates of varying particle sizes are known in the art. The units of the components of Refractory Mixtures L–Q were based on the magnesium oxide aggregate content being set to 400 parts and all other components were then set to parts per 400 of magnesium oxide.

| Refractory Mixture L | |
|---|---|
| Magnesium oxide | 400 |
| MAGCHEM 50 | 4 |
| Resin 1 | 40 |
| Water | 8 |

Magnesium oxide (aggregate) and MAGCHEM 50 were mixed for 2 minutes, then the resin and water were added and mixed for 3 minutes uniformly. 45 g samples were hand-pressed into nuggets having a surface area of 2.07 $in^2$ (1 and ⅝-inch diameter). The results of the compressive strength of the binders is summarized in Table 4.

| Refractory Mixture M | |
|---|---|
| Magnesium oxide | 400 |
| MAGCHEM 50 | 2.4 |
| Resin 1 | 24 |
| Water | 16 |

Magnesium oxide (aggregate) and MAGCHEM 50 were mixed for 2 minutes, then the resin and water were added and mixed for 5 minutes uniformly. The product material was vibratable. 45 g samples were hand-pressed into nuggets. The results of the compressive strength of the binders is summarized in Table 4.

| Refractory Mixture N | |
|---|---|
| Magnesium oxide | 400 |
| MAGCHEM 50 | 1.92 |
| Resin 1 | 24 |
| Water | 16 |

Magnesium oxide (aggregate) and MAGCHEM 50 were mixed for 5 minutes, then the resin and water were added and mixed for 5 minutes. The mixture was wet initially, then gradually dried out. The product mixture was vibratable. 45 g samples were hand-pressed into nuggets. The results of the compressive strength of the binders is summarized in Table 4.

| Refractory Mixture P | |
|---|---|
| Magnesium oxide | 400 |
| MAGCHEM 50 | 1.92 |
| Resin 1 | 24 |
| Water | 10 |

Magnesium oxide (aggregate) and MAGCHEM 50 were mixed uniformly for 5 minutes, then the resin and water were added and mixed for 5 minutes. Agglomeration was suppressed resulting in relatively small particle size. The product mixture was very vibratable. 45 g samples were hand-pressed into nuggets. The results of the compressive strength of the binders is summarized in Table 4.

| Refractory Mixture Q | |
|---|---|
| Magnesium oxide | 400 |
| MAGCHEM 50 | 1.28 |
| Resin 1 | 16 |
| Water | 10 |

Magnesium oxide (aggregate) and MAGCHEM 50 were mixed thoroughly, then the resin and water were added and mixed for 5 minutes. The mixture had the appearance of damp sand. The product mixture was vibratable. 45 g samples were hand-pressed into nuggets. The results of the compressive strength of the binders is summarized in Table 4.

TABLE 4

Compressive Strength Results for Refractory Mixtures L–Q

| Refractory Mixture/Time/ Temperature | Sample | Compressive Strength, psi |
|---|---|---|
| L/3 hours/room temperature | 1 | 1229 |
| | 2 | 1040 |
| | 3 | 1028 |
| L/1 hour at room temperature then 1 hour at 125° C. | 1 | 12500 |
| | 2 | 4466 |
| | 3 | 2521 |
| L/24 hours/room temperature | 1 | 1268 |
| | 2 | 875 |
| | 3 | 1175 |

TABLE 4-continued

Compressive Strength Results for Refractory Mixtures L–Q

| Refractory Mixture/Time/ Temperature | Sample | Compressive Strength, psi |
|---|---|---|
| M/3 hours/room temperature | 1 | 744 |
| | 2 | 150 |
| | 3 | 222 |
| M/1 hour at 125° C. | 1 | 2036 |
| | 2 | 2106 |
| | 3 | 1210 |
| M/24 hours/room temperature | 1 | 928 |
| | 2 | 553 |
| | 3 | 643 |
| N/3 hours/room temperature | 1 | 485 |
| | 2 | 389 |
| | 3 | 210 |
| N/1 hour at 125° C. | 1 | 3084 |
| | 2 | 983 |
| | 3 | 918 |
| N/24 hours/room temperature | 1 | 534 |
| | 2 | 360 |
| | 3 | 476 |
| P/3 hours/room temperature | 1 | 785 |
| | 2 | 399 |
| | 3 | 176 |
| P/1 hour at 125° C. | 1 | 2411 |
| | 2 | 751 |
| | 3 | 1080 |
| P/24 hours/room temperature | 1 | 1022 |
| | 2 | 457 |
| | 3 | 268 |
| Q/1 hour at 125° C. | 1 | 182 |
| | 2 | 128 |
| | 3 | 145 |
| Q/24 hours/room temperature | 1 | 250 |
| | 2 | 68 |
| | 3 | 130 |

There have been described here various compositions of refractory mixtures comprising resole resins containing varying levels of magnesium oxide as a hardening agent. The prior art teaches that strength of binders using resins having a P/F ratio in the range of 1:1 to 1:3 should result in refractories of similar strength. The results of the experiments described above have shown surprising and unexpected results related to the use of resole resins having a P/F ratio in the range of 1:2.0 to about 1:2.4.

With reference to Table 2, the compression strengths of refractories prepared using resins of differing P/F ratios are compared. The compression strength of refractories in the range of P/F ratios of about 1:1 to about 1:1.5 are surprisingly lower than the compression strengths of refractories containing resins that have a P/F ratio of between about 1:2.0 and about 1:2.4. No compression strength could effectively be measured for P/F, ratios of 1:0.9 (Examples E, H). For P/F ratio 1:1.5 (Example G), low compression strengths ranging from 6 psi after 3 hours at room temperature to 114 psi after 22 hours at room temperature were observed. In contrast, a preferred P/F ratio of 1:2.2 (Example F) provided compression strengths ranging from 242 psi after 3 hours at room temperature to 363 psi after 22 hours at room temperature, an increase of ca. 4000% and 218%, respectively. Using the preferred P/F ratio, unexpected improvements in compression strengths can range from about 200 psi up to >10,000 psi, as described in the foregoing examples. It has been found that the resins having a P/F ratio ranging from about 1:2.0 to about 1:2.4 are critical elements of the present invention. A preferred P/F ratio is 1:2.2.

It should be understood that various changes and modifications preferred in the embodiment described herein will be apparent to those skilled in the art. Such changes and modifications can be made without departing from the spirit and scope of the present invention and without demising the attendant advantages. It is, therefore, intended that such changes and modifications be covered by the appended claims.

What is claimed is:

1. A composition comprising:

a) a liquid resale having a mole ratio of phenol to formaldehyde ranging from about 1:2.0 to about 1:2.4, the liquid resole further having a pH range from about 8 to about 9;

b) an aggregate; and c) a lightburned magnesium hardening agent.

2. The composition of claim 1 which has been hardened at ambient temperature.

3. The composition of claim 1 wherein the liquid resole is present in an amount ranging from about 1% to about 20% by weight, based on the total weight of the aggregate.

4. The composition of claim 1 wherein the liquid resole is present in an amount ranging from about 4% to about 10% by weight, based on the total weight of the aggregate.

5. The composition of claim 1 wherein the composition further comprises a solvent.

6. The composition of claim 5 wherein the solvent is selected from the group consisting of water, γ-butyrolactone, and mixtures thereof.

7. The composition of claim 5 wherein the solvent is water.

8. The composition of claim 5 wherein die solvent is γ-butyrolactone.

9. The composition of claim 1 wherein the mole ratio of phenol to formaldehyde is about 1:2.2.

10. The composition of claim 1 wherein the aggregate is silica sand.

11. The composition of claim 1 wherein the aggregate is magnesium oxide.

12. The composition of claim 1 wherein the lightburned magnesium hardening agent is lightburned magnesium oxide.

13. The composition of claim 3 wherein the lightburned magnesium hardening agent is lightburned magnesium oxide.

14. The composition of claim 13 wherein the lightburned magnesium oxide is present in an amount ranging from about 0.5% to about 50% by weight, based on the total weight of the liquid resole.

15. The composition of claim 13 wherein the lightburned magnesium oxide is present in an amount ranging from about 3% to about 15% by weight, based on the total weight of the liquid resole.

16. The composition of claim 12 wherein the lightburned magnesium oxide has a surface area of about 10 to about 200 square meters per gram.

17. The composition of claim 12 wherein the lightburned magnesium oxide has a surface area of about 50 to about 100 square meters per gram.

18. A binder composition, comprising:

an aggregate;

a liquid resole having a mole ratio of phenol to formaldehyde ranging from about 1:2.0 to about 1:2.4, the liquid resole further having a pH range from about 8 to 9, in an amount ranging from about 1% to about 20% by weight, based on the total weight of the aggregate;

lightburned magnesium oxide in an amount ranging from about 0.5% to about 50% by weight, based on the total weight of the liquid resole; and a solvent in an amount ranging from 0% to about 25% by weight, based on the total weight of the aggregate.

19. The binder composition of claim 13 wherein the aggregate is silica sand.

20. The binder composition of claim 18 wherein the aggregate is magnesium oxide.

21. A binder composition, comprising:

magnesium oxide;

a liquid resole having a mole ratio of phenol to formaldehyde of 1:2.2, the liquid resole further having a pH range from about 8 to about 9, in an amount ranging from about 4% to about 10% by weight, based on the total weight of magnesium oxide;

lightburned magnesium oxide in an amount ranging from about 8% to about 15% by weight, based on the total weight of liquid resole; and water in an amount ranging from 2% to about 8% by weight, based on the total weight of magnesium oxide.

22. A binder composition, comprising;

silica sand:

a liquid resole having a mole ratio of phenol to formaldehyde or 1:2.2, the liquid resole further having a pH range from about 8 to about 9, in an amount ranging from about 4% to about 10% by weight, based on the total weight of silica sand;

lightburned magnesium oxide in an amount ranging from about 12% to about 18% by weight, based on the total weight of the liquid resole; and water in an amount ranging from 2% to about 8% by weight, based on the total weight of silica sand.

* * * * *